United States Patent [19]

Satoh

[11] Patent Number: 4,506,127

[45] Date of Patent: Mar. 19, 1985

[54] HIGH-FREQUENCY HEATING APPARATUS

[75] Inventor: Kenji Satoh, Yokohama, Japan

[73] Assignee: Hitachi Heating Appliances Co., Ltd., Chiba, Japan

[21] Appl. No.: 33,340

[22] Filed: Apr. 25, 1979

[30] Foreign Application Priority Data

Apr. 28, 1978 [JP] Japan ..... 53-51128

[51] Int. Cl.[3] ..... H05B 6/68

[52] U.S. Cl. ..... 219/10.55 B; 219/10.55 R

[58] Field of Search ..... 219/10.55 B, 10.55 R, 219/10.55 E

[56] References Cited

U.S. PATENT DOCUMENTS

| | | | |
|---|---|---|---|
| 3,470,942 | 10/1969 | Fukada et al. | 219/10.55 B X |
| 3,569,656 | 3/1971 | White | 219/10.55 B |
| 4,035,787 | 7/1977 | Hornung | 219/10.55 B X |
| 4,041,267 | 8/1977 | Wechsler | 219/10.55 B |
| 4,130,749 | 12/1978 | Tanaka et al. | 219/10.55 B |
| 4,149,057 | 4/1979 | Fritts | 219/10.55 B |
| 4,162,381 | 7/1979 | Buck | 219/10.55 B |

FOREIGN PATENT DOCUMENTS

| | | | |
|---|---|---|---|
| 2753405 | 6/1978 | Fed. Rep. of Germany | 219/10.55 B |
| 43-16955 | 7/1968 | Japan | 219/10.55 B |
| 52-17236 | 2/1977 | Japan | 219/10.55 B |
| 52-17237 | 2/1977 | Japan | 219/10.55 B |

OTHER PUBLICATIONS

"Automatic Control System for MW Ovens", by Sato et al., from Microwave Power Symposium 1978 Digest, Jun. 1978.

*Primary Examiner*—Philip H. Leung

*Attorney, Agent, or Firm*—Antonelli, Terry & Wands

[57] ABSTRACT

A high-frequency heating apparatus including a heating chamber accommodating an object to be heated and a high-frequency oscillator supplying its high-frequency output into the heating chamber to heat the object by the high-frequency energy. The high-frequency heating apparatus comprises an output change-over device for changing over the level of the high-frequency output of the high-frequency oscillator and a temperature sensing device for sensing the temperature of the object being heated. The output change-over device is actuated to reduce the power level of the high-frequency output of the high-frequency oscillator when the level of the output signal of the temperature sensing device attains a predetermined temperature setting, and thereafter, the high-frequency oscillator supplying the high-frequency output of reduced power level is turned on-off a plurality of times depending on the level of the output signal of the temperature sensing device relative to the temperature setting.

20 Claims, 6 Drawing Figures

HIGH-FREQUENCY HEATING APPARATUS

This invention relates to high-frequency heating apparatus, and more particularly to a high-frequency heating apparatus provided with a heating control device for automatically controlling the heat supplied to an object to be heated.

The prior art and the present invention will be described with reference to the accompanying drawings, in which.

In a high-frequency heating apparatus, a high-frequency output of a high-frequency oscillator is supplied into a heating chamber accommodating an object to be heated therein so as to heat the object up to a predetermined temperature. A heating control method has been proposed to maintain substantially constant the temperature of an object being heated in such a high-frequency heating apparatus. For example, U.S. Pat. No. 3,569,656 to Edward A. White issued Mar. 9, 1971 discloses an automatic cooking cycle control system for microwave ovens. According to this proposed heating control system, a temperature sensing device is provided to sense the temperature of the object being heated and to generate an output signal indicative of the sensed temperature, and after the temperature of the object being heated has attained a predetermined setting, the high-frequency energy supplying operation of the high-frequency oscillator which has so far continued is repeatedly turned on and off for a period of time set by a timer. After the period of time set by the timer has elapsed, the heating operation stops. The temperature of the object is no longer controlled after the intermittent on-off heating operation of the high-frequency oscillator has been initiated by the timer. Therefore, the merits of heating control by temperature detection may be greately reduced. In the control system of U.S. Pat. No. 3,569,656, an improvement has been proposed to control the on-off operation of the high-frequency oscillator depending on the temperature detection of the object being heated. The operation principle of the conventional control systems including that disclosed in the above-mentioned U.S. Pat. No. 3,569,656 is illustrated in FIG. 1.

Figure 1:
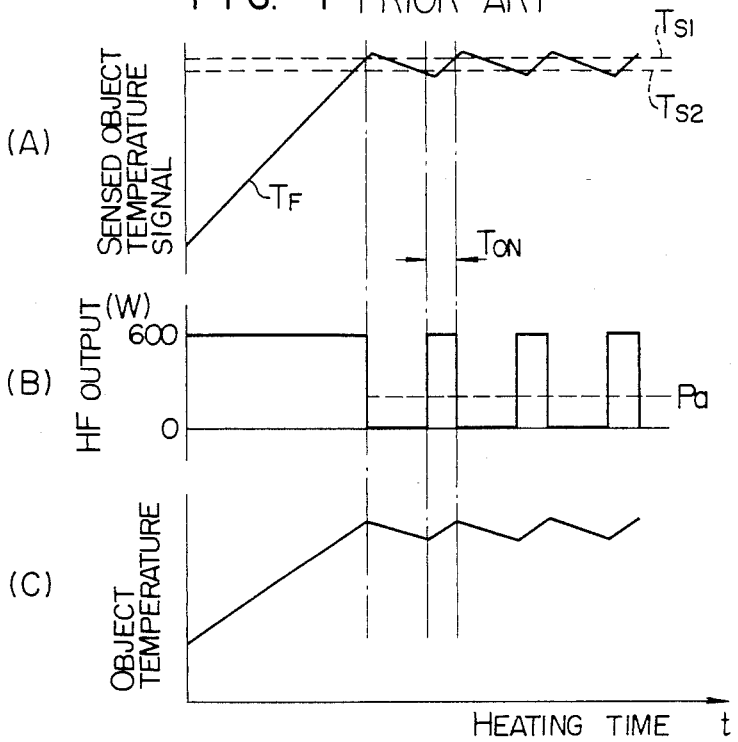
FIG. 1 PRIOR ART
FIG. 1 illustrates a prior art method of controlling the high-frequency output of a high-frequency oscillator.

Referring to FIG. 1, the high-frequency output (which is, for example, 600 watts) of the high-frequency oscillator is continuously supplied until the level of the output signal $T_F$ of the temperature sensing device indicative of the sensed temperature of the object being heated attains a first temperature setting $T_{S1}$, as shown in (A) and (B) of FIG. 1. At the time at which the relation $T_F > T_{S1}$ holds, the high-frequency oscillator is turned off and ceases to supply its high-frequency output, with the result that the level of the output signal $T_F$ of the temperature sensing device indicative of the sensed temperature of the article being heated is gradually lowered toward a second temperature setting $T_{S2}$. At the time at which the relation $T_F < T_{S2}$ holds, the high-frequency oscillator is turned on to supply its high-frequency output again, and the level of the output signal $T_F$ of the temperature sensing device rises again toward the first temperature setting $T_{S1}$. In this manner, the temperature of the article being heated is continuously sensed by the temperature sensing device, and after the level of the temperature signal $T_F$ indicative of the sensed temperature of the article has attained a predetermined level, the high-frequency oscillator supplying the high-frequency output is repeatedly turned on and off depending on the level of the temperature signal $T_F$ indicative of the sensed temperature of the article, so that the temperature of the article being heated can be maintained substantially constant as shown in (C) of FIG. 1.

It will be seen from FIG. 1 that the illustrated heating control method comprises initially continuously supplying the high-frequency output of the high-frequency oscillator to heat an object with strong heating power and subsequently intermittently supplying the high-frequency output to heat the object with weakened heating power or reduced effective power Pa, as shown in (B) of FIG. 1. Such a method is commonly employed in cooking food to obtain, for example, a hotchpotch or stew. In the food cooking of the kind above described, it is necessary to initially supply strong heating power until the soup or stock boils up and subsequently to maintain a state of gentle boiling (in other words, to maintain a temperature of about 95° C.) for a required length of time. By maintaining the heating temperature at such a level, $\beta$-starch of potatoes, for example, is progressively turned into $\alpha$-starch, the protein of fishes and meats is progressively coagulated, the flavor of the gravy or soup permeates the ingredients, and the emulsification proceeds further, so that a tender and tasty hotchpotch or stew can be obtained.

In the conventional control illustrated in FIG. 1, the smaller the temperature difference between the two temperature settings $T_{S1}$ and $T_{S2}$ used for controlling the oscillation of the high-frequency oscillator, the length of time of the on-off cycle becomes correspondingly shorter. An excessively shortened length of time of the on-off cycle results in a shortened useful service life of the high-frequency oscillator. Especially, this excessively shortened length of time of the on-off cycle exerts a further adverse effect on the useful service life of the high-frequency oscillator in a high-frequency heating apparatus in which the transformer energizing the heater of the high-frequency oscillator is eliminated for the purpose of reduction of the total cost of the apparatus. Therefore, the on-off control of the high-frequency oscillator must be carried out as gradual as possible.

Various temperature sensing methods have been proposed hitherto as the means for sensing the temperature of the article being heated. However, in any one of the proposed temperature sensing methods, the level of the temperature signal $T_F$ indicative of the sensed temperature of the article starts to rise with a slight delay time after the temperature of the article starts to elevate by being heated by the high-frequency heating power, due to the thermal time constant of the temperature sensing device. This tendency will be readily seen from comparison between (C) and (A) of FIG. 1.

Therefore, the period $T_{ON}$ during which the high-frequency oscillator is kept turned on to continuously supply its high-frequency output to the object before being turned off must be extended to a certain extent, when the useful service life of the high-frequency oscillator is considered in relation to the delayed response of the object's temperature sensing device.

As a consequence, the problem of, for example, boil-over of the soup from the container containing the object to be heated arises inevitably due to the extended on-time $T_{ON}$ of the high-frequency oscillator from which the high-frequency output of 600 watts is intermittently supplied to the object. In cooking food to obtain a hotchpotch or stew, this boil-over tends to occur frequently since the container is covered by a lid. This boil-over tends to occur especially most frequently in the case of cooking of a starchy foodstuff such as a taro which tends to develop bubbles with the progress of heating.

It is therefore a primary object of the present invention to obviate the prior art defects pointed out above and to provide a high-frequency heating apparatus provided with a heating control device which controls automatically the high-frequency output of the high-frequency oscillator depending on the sensed temperature of an object being heated so that the stock or soup may not boil over from the container containing the object, as when a hotchpotch or stew is cooked by initially supplying strong heating power to the ingredients and subsequently supplying reduced effective heating power.

The present invention which attains the above object is featured by the fact that the high-frequency output of the high-frequency oscillator is changed over to its reduced power level when the temperature signal indicative of the sensed temperature of the object being heated attains a predetermined setting, and subsequently, the high-frequency oscillator supplying the high-frequency output of reduced power level is turned on and off depending on the level of the temperature signal indicative of the sensed temperature of the object.

Preferred embodiments of the present invention will now be described in detail with reference to the drawings.

Figure 2:
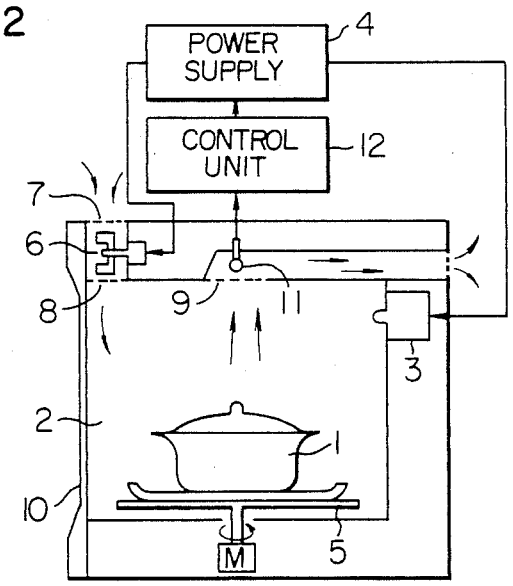
FIG. 2 is a diagrammatic view showing the structure of an embodiment of the high-frequency heating apparatus according to the present invention.

FIG. 2 shows diagrammatically the structure of an embodiment of the high-frequency heating apparatus according to the present invention. In FIG. 2, reference numeral 1 is used to generally designate food to be cooked although it is actually contained in a container as shown. In the embodiment of the present invention shown in FIG. 2, a method of sensing the temperature of air being discharged from a heating chamber 2 of the high-frequency heating apparatus is employed, by way of example, as a means for sensing the temperature of the food 1. This method utilizes the fact that, as the food 1 placed within the heating chamber 2 is heated by a high-frequency output supplied from a high-frequency oscillator 3 which may include a magnetron, the temperature of the air within the heating chamber 2 rises, and this is followed by a corresponding rise in the temperature of air discharged to the exterior from the heating chamber 2. The high-frequency oscillator 3 oscillates by being energized by energizing power supplied from a power supply unit 4 and heats the food 1 placed on a turntable 5 within the heating chamber 2. A ventilating fan 6 for ventilating the heating chamber 2 is driven during the period of heating. External air is sucked by the rotating ventilating fan 6 to pass through an air inlet opening 7 of the high-frequency heating apparatus, thence, to flow into the heating chamber 2 through an air inlet opening 8 of the latter. The air passes then around the food 1 and is finally discharged to the exterior of the heating chamber 2 through an air outlet opening 9 formed in the upper wall of the heating chamber 2. The high-frequency heating apparatus includes an access door 10 which does not permit passage of air therethrough and openably closes the heating chamber 2. The air outlet opening 9 of the heating chamber 2 is formed by, for example, a perforated member having many perforations and is thus so designed that it does not permit leakage of the high-frequency energy to the exterior of the heating chamber 2 although air can freely pass therethrough.

A temperature sensor 11 is disposed in the discharge passage of air so as to sense the temperature of air being discharged from the heating chamber 2, and its output signal indicative of the sensed temperature of discharge air is applied to a control unit 12. In the control unit 12, the temperature signal indicative of the discharge air temperature sensed by the temperature sensor 11 is compared with a reference signal indicative of a predetermined discharge air temperature setting. When the predetermined temperature setting is reached with the rise of the temperature of discharge air due to the heat generated from the food 1, the control unit 12 applies a switching signal to the power supply unit 4 so as to change over the high-frequency output of the high-frequency oscillator 3 from its full power level to its reduced power level. Thereafter, the control unit 12 applies an on-off control signal to the power supply unit 4 depending on the temperature of discharge air sensed by the temperature sensor 11 so as to make on-off control of the oscillation of the high-frequency oscillator 3.

As described above, the present invention is featured by the fact that the high-frequency oscillator initially continuously supplies its high-frequency output of full power level to heat an object until the temperature of discharge air attains a predetermined setting, and then supplies its high-frequency output of reduced power level after the temperature of discharge air attains the predetermined setting, and thereafter, the high-frequency oscillator supplying the high-frequency output of reduced power level is turned on and off depending on the temperature of discharge air, so that heating is continued in the state in which both the peak heating power and the effective heating power are reduced.

Figure 3:
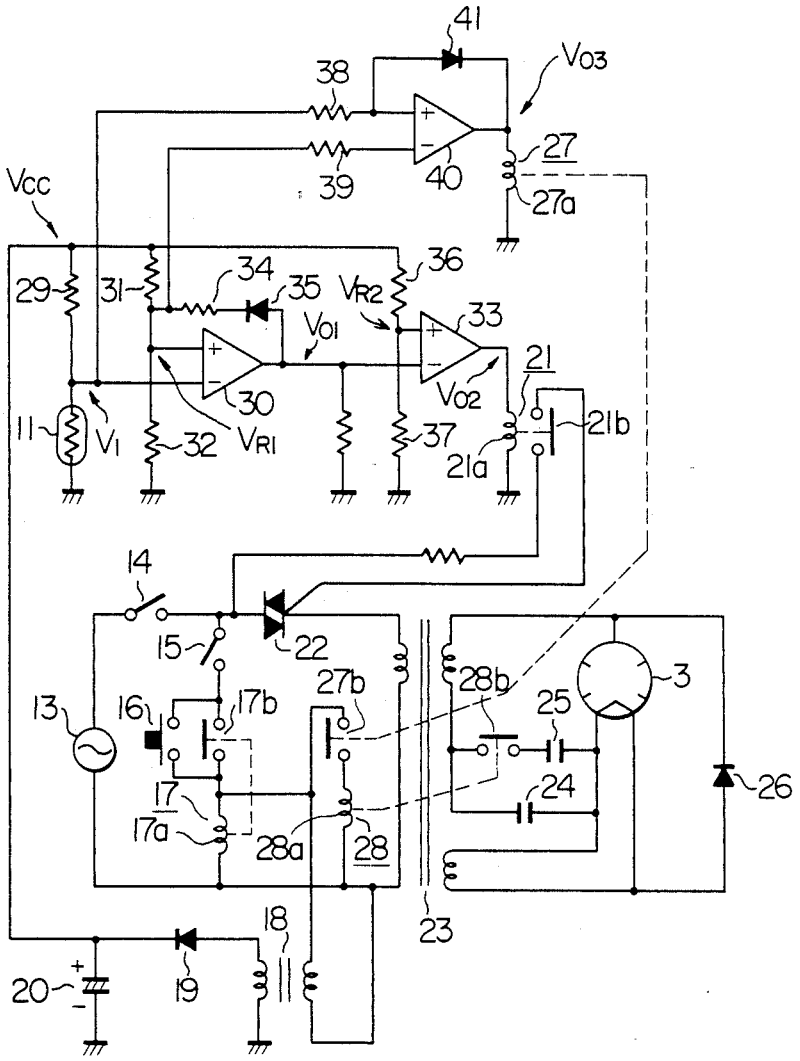
FIG. 3 is a circuit diagram of a high-frequency output control circuit preferably employed in the high-frequency heating apparatus according to the present invention shown in FIG. 2.
Figure 4:
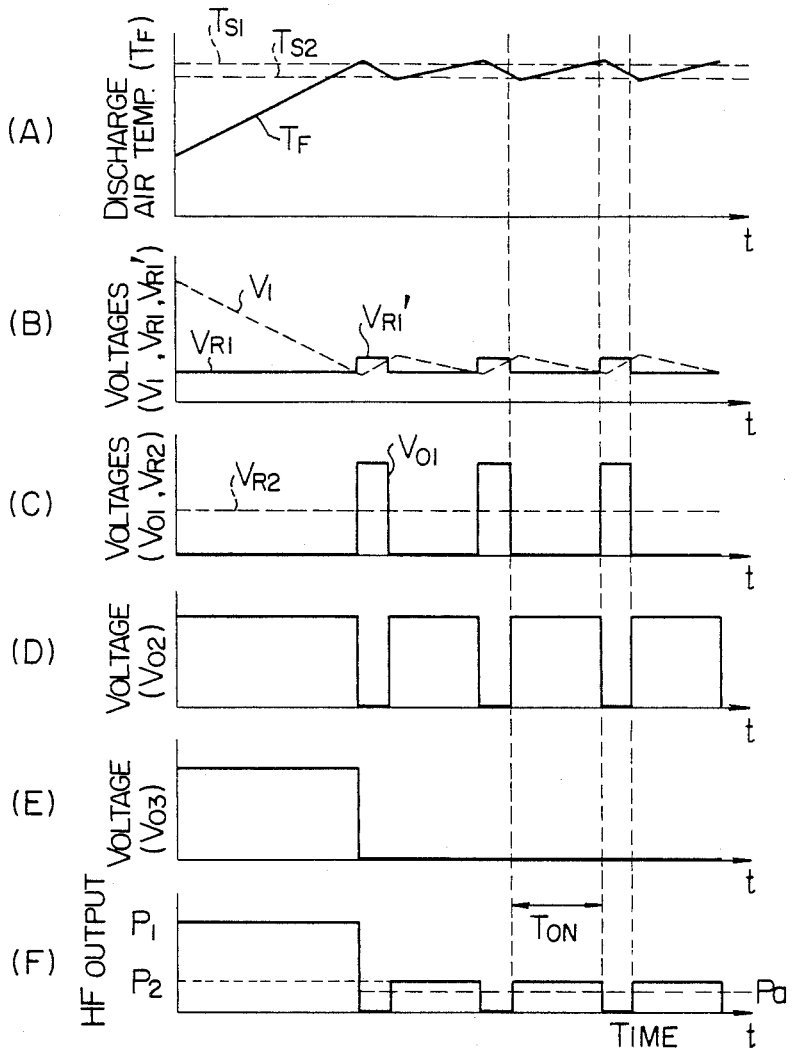
FIG. 4 illustrates the operation of the high-frequency output control circuit shown in FIG. 3.

FIG. 3 shows the structure of one form of the control unit 12 together with the structure of the power supply unit 4 and the structure of the high-frequency oscillator 3 shown in FIG. 2. FIG. 4 illustrates the operation of the circuit shown in FIG. 3. The temperature sensor 11 shown in FIG. 3 is in the form of a thermistor.

Referring to FIG. 3, reference numeral 13 designates a commercial AC power source at 100 volts and 50/60 Hz. A door switch 14 and a latch switch 15 are closed when the access door 10 is closed after placement of a food 1 in the heating chamber 2 of the high-frequency heating apparatus. Then, when a cook switch 16 is depressed, the AC voltage of 100 volts is applied across a coil **17*a* of a relay 17 to close a relay contact 17*b* of the relay 17. The contact 17*b* of the relay 17 holds itself and remains closed even after the hand of the user is released from the cook switch 16 to turn off the switch 16. Consequently, the AC voltage of 100 volts is applied across a primary winding of a low-voltage transformer 18 connected in parallel with the coil 17***a* of the relay 17 as soon as the cook switch 16 is depressed, and a rectifier circuit composed of a diode 19 and a capacitor 20 connected to a secondary winding of the transformer 18 produces a DC voltage $V_{cc}$ which is applied to the control circuit as a power supply voltage. An energizing voltage is applied across a coil 21*a* of a relay 21 thereby closing a contact 21*b* of this relay 21. Consequently, a gate signal is applied to the gate of a triac 22 to turn on the triac 22. The AC voltage of 100 volts is now applied across a primary winding of a high-voltage transformer 23, and a voltage multiplying half-wave rectifier circuit composed of high-voltage capacitors 24, 25 and a high-voltage rectifier 26 connected to secondary windings of the transformer 23 produces a high DC voltage which is applied across the anode and the cathode of the high-frequency oscillator 3. Consequently, the high-frequency oscillator 3 starts to oscillate and generate its high-frequency output so that heating of the food 1 is started. When the heating of the food 1 is started, the high-voltage capacitors 24 and 25 make parallel operation, since a contact 27*b* of a relay 27 is closed, and a contact 28*b* of another relay 28 is also closed, as described later.

In FIG. 3, a resistor 29 is connected in series with the temperature sensor 11, which is a thermistor in this embodiment, so as to divide the DC voltage $V_{cc}$. Thus, an input voltage signal $V_1$ inversely proportional to the sensed temperature $T_F$ of air being discharged from the heating chamber 2, that is, the temperature corresponding to the temperature of the food 1 being heated in the heating chamber 2, is applied to a negative input terminal of a first comparator 30. The temperature $T_F$ of discharge air corresponding to the temperature of the food 1 being heated rises in a manner as shown in (A) of FIG. 4, and the input signal voltage $V_1$ inversely proportional to the above temperature has a waveform as shown in (B) of FIG. 4. On the other hand, a reference voltage $V_{R1}$ obtained by dividing the DC voltage $V_{cc}$ by resistors 31 and 32 and having a waveform as also shown in (B) of FIG. 4 is applied to a positive input terminal of the first comparator 30. This reference voltage $V_{R1}$ represents a predetermined temperature setting so that heating of the food 1 is stopped when this temperature setting is reached. The first comparator 30 compares the voltage $V_1$ inversely proportional to the sensed food temperature with the reference voltage $V_{R1}$ and applies its output voltage $V_{01}$ to a negative input terminal of a second comparator 33. This output voltage $V_{01}$ has a waveform as shown in (C) of FIG. 4.

A resistor 34 and a diode 35 are connected in series across the output terminal and the positive input terminal of the first comparator 30 so that the reference voltage, on the basis of which the on-off of oscillation of the high-frequency oscillator 3 is controlled, takes two values $V_{R1}$ and $V'_{R1}$ as shown in (B) of FIG. 4. These two reference voltages $V_{R1}$ and $V'_{R1}$ terminate at two temperature settings $T_{S1}$ and $T_{S2}$ respectively of the discharge air so that the high-frequency oscillation is turned on during the period of $V_{R1}$ and turned off during the period of $V'_{R1}$.

The output voltage $V_{01}$ of the first comparator 30 is applied to the negative input terminal of the second comparator 33, as described above. On the other hand, a second reference voltage $V_{R2}$ obtained by dividing the DC voltage $V_{cc}$ by resistors 36 and 37 is applied to a positive input terminal of the second comparator 33. This second reference voltage $V_{R2}$ has a level as shown in (C) of FIG. 4. The second comparator 33 compares the output voltage $V_{01}$ of the first comparator 30 with the second reference voltage $V_{R2}$ and applies its output voltage $V_{02}$ to the coil 21*a* of the relay 21. This output voltage $V_{02}$ has a waveform as shown in (D) of FIG. 4. The contact 21*b* of the relay 21 is closed or opened depending on the high or low level of the output voltage $V_{02}$ of the second comparator 33 thereby switching the triac 22 correspondingly so that the oscillation of the high-frequency oscillator 3 is intermittently on-off controlled as shown in (F) of FIG. 4.

The voltage $V_1$ inversely proportional to the sensed food temperature and the first reference voltage $V_{R1}$ are also respectively connected to a positive input terminal and a negative input terminal of a third comparator 40 through resistors 38 and 39 each having a high resistance value. The third comparator 40 compares the voltage $V_1$ with the voltage $V_{R1}$ to provide its output voltage $V_{03}$ having a waveform as shown in (E) of FIG. 4. A positive feedback diode 41 is connected across the output terminal and the positive input terminal of the third comparator 40 so that, after the inversion of the output voltage $V_{03}$ from its high level to its low level, this low level can be maintained independently of the variation of the input voltage signal $V_1$. The resistance value of the resistor 38 is selected to be sufficiently larger than that of the thermistor 11 so that the value of the input voltage $V_1$ may not substantially vary regardless of the on-off of the diode 41. The output voltage $V_{03}$ of the third comparator 40 is connected to a coil 27*a* of a relay 27 to close or open its contact 27*b*. A contact 28*b* of an AC relay 28 is closed or opened in interlocking relation with the on-off of the contact 27*b* of the relay 27 thereby controlling the connection of the high-voltage capacitor 25 to the high-frequency oscillating tube 3.

The first reference voltage $V_{R1}$ is so selected as to satisfy the relation $V_1 > V_{R1}$ before the heating is started. Thus, the output voltage $V_{01}$ of the first comparator 30 takes its low level, and the output voltage $V_{02}$ of the second comparator 33 takes its high level. The contact 21*b* of the relay 21 is closed, and the triac 22 is turned on to permit oscillation of the high-frequency oscillator 3. Since the relation $V_1 > V_{R1}$ holds at this time, the outout voltage $V_{03}$ of the third comparator 40 takes its high level as shown in (E) of FIG. 4. Consequently, the high-voltage capacitor 25 is connected in parallel with the high-voltage capacitor 24, and the high-frequency output of the high-frequency oscillator 3 is in its full power level $P_1$ of, for example, 600 watts as shown in (F) of FIG. 4.

With the progress of heating, the temperature of the food 1 rises gradually, and the resistance value of the thermistor 11 decreases gradually resulting in a corresponding reduction of the voltage $V_1$ in a relation inversely proportional to the sensed food temperature. When the temperature of the food 1 rises above the level of the first predetermined temperature setting $T_{S1}$ as shown in (A) of FIG. 4, the relation $V_I < V_{R1}$ holds, and the output voltage $V_{03}$ of the third comparator 40 is inverted from its high level to its low level. Consequently, the high-voltage capacitor 25 is disconnected from the control circuit, and the high-frequency output of the high-frequency oscillator 3 is changed over to its reduced power level P2 of, for example, 200 watts as shown in (F) of FIG. 4. Threafter, the output voltage $V_{03}$ of the third comparator 40 is maintained in its low level by the positive feedback action of the diode 41, and the high-frequency oscillator 3 continues to generate its high-frequency output of reduced power level P2. Further, when the relation $V_I < V_{R1}$ holds, the output voltage $V_{01}$ of the first comparator 30 is inverted to its high level from the low level, and therefore, the output voltage $V_{02}$ of the second comparator 33 is inverted to its low level from the high level. Consequently, the current flowing through the coil 21*a* of the relay 21 is reduced to open the contact 21*b* of the relay 21. The triac 22 is turned off, and the high-frequency oscillator 3 ceases to oscillate.

When the high-frequency oscillation ceases to stop the heating operation the temperature of the food 1 falls gradually resulting in a corresponding fall of the temperature $T_F$ of air discharged from the heating chamber 2. With the fall of the temperature $T_F$ of discharge air, the voltage $V_1$ inversely proportional to the sensed food temperature starts to increase, and when it increases to a level higher than $V'_{R1}$, that is, when the relation $V_1 > V'_{R1}$ is attained, the high-frequency oscillation is re-started. Thus, the high-frequency oscillation is stopped when the voltage $V_1$ inversely proportional to the sensed food temperature decreases to a level lower than the reference voltage level $V_{R1}$, and the oscillation is re-started when the voltage $V_1$ increases to a level higher than the reference voltage level $V'_{R1}$. As seen in (B) of FIG. 4, the reference voltage level $V'_{R1}$ is selected to be slightly higher than the reference voltage level $V_{R1}$. This difference is provided by the action of the diode 35 connected to the output terminal of the first comparator 30. The diode 35 is in its cut-off state during the period in which the output voltage $V_{01}$ of the first comparator 30 is in its low level and the high-frequency oscillator 3 is oscillating, while the diode 35 conducts in response to the inversion of the output voltage $V_{01}$ of the first comparator 30 from its low level to its high level, so that the level of the reference voltage applied to the positive input terminal of the first comparator 30 is slightly elevated from $V_{R1}$ to $V'_{R1}$. Therefore, the oscillation re-starting temperature setting $T_{S2}$ of the discharge air temperature is also slightly lower than the oscillation stopping temperature setting $T_{S1}$, as seen in (A) of FIG. 4. Thus, the diode 35 acts to provide a hysteresis in the setting of the discharge air temperature $T_F$ so as to prevent the high-frequency oscillator 3 from being incessantly turned on and off due to fluctuations of the discharge air temperature $T_F$ corresponding to the food temperature thereby avoiding an adverse effect on the useful service life of the high-frequency oscillator 3.

It will be seen that the method of high-frequency heating by the high-frequency heating apparatus according to the present invention comprises sensing the temperature of air being discharged from the heating chamber 2 by means of the thermistor 11 thereby indirectly sensing the temperature of the food 1 placed within the heating chamber 2, disconnecting the high-voltage capacitor 25 from the control circuit in response to the output of the third comparator 40 thereby changing over the high-frequency output of the high-frequency oscillator 3 to its reduced power level when the temperature setting is reached, and thereafter controlling the on-off of the triac 22 depending on the temperature of discharge air thereby intermittently turning on-off the high-frequency oscillation so as to maintain substantially constant the temperature of the food 1 being heated in the heating chamber 2. For example, when a hotchpotch or stew is cooked, strong heat is initially applied with the full power level P1=600 watts of the high-frequency output until the soup boils up, and thereafter, the high-frequency output is switched to its reduced power level P2=200 watts which is intermittently supplied to heat the food with the reduced heating power, that is, the effective heating power Pa shown in (F) of FIG. 4. This manner of cooking is advantageous in that the problem of boil-over of the soup from the food container would not arise in spite of an elongation of the length of time $T_{ON}$ during which the high-frequency output of reduced power level is supplied to heat the food, as shown in (F) of FIG. 4. This is because the peak value P2 of the high-frequency output in such a heating stage is only 200 watts. It has been experimentally confirmed that boil-over of the soup does not substantially occur when the peak value P2 of the high-frequency output during heating with the reduced heating power is lower than at least 250 watts. In the cooking of the hotchpotch or stew, the ingredients can be sufficiently rendered soft and tender when the peak value P2 of the high-frequency output during heating with the reduced heating power is higher than at least 150 watts. It is therefore desirable to select the peak value P2 of the high-frequency output to lie between 150 watts and 250 watts. According to the aforementioned embodiment of the present invention, the high-frequency output is automatically controlled depending on the temperature $T_F$ of discharge air corresponding to the temperature of the food being heated. Therefore, the amount of energy exactly required to heat the food is supplied without any wasteful consumption of heating power, and the possibility of excessive heating resulting in disintegration of the ingredients as well as the possibility of insufficient heating is obviated so that the hotchpotch or stew thus prepared is quite tasty.

In the embodiment of the present invention described with reference to FIGS. 3 and 4, the temperature $T_F$ of air discharged from the heating chamber 2 is sensed, by way of example, in order to obtain the temperature signal indicative of the temperature of the food being heated. However, various other methods may also be effectively employed in the present invention. Such methods include, for example, a method of bringing a high-frequency shielded temperature sensor into contact with the food or inserting such a sensor into the food, a method of directly sensing the temperature of air in the heating chamber, a method of sensing the variation in the humidity of air surrounding the food due to vapor liberated from the food, and a method of sensing the infrared ray radiation emitted from the food.

In the aforementioned embodiment of the present invention, the elements including the third comparator 40 are provided to act as a means for disconnectably connecting one of the high-voltage capacitors to the high-frequency oscillator 3 thereby changing over its high-frequency output between the two levels. However, the high-frequency output may be changed over by a method in which, for example, the turns ratio between the primary winding and the secondary winding of the high-voltage transformer 23 is changed over by any suitable means.

Figure 5:
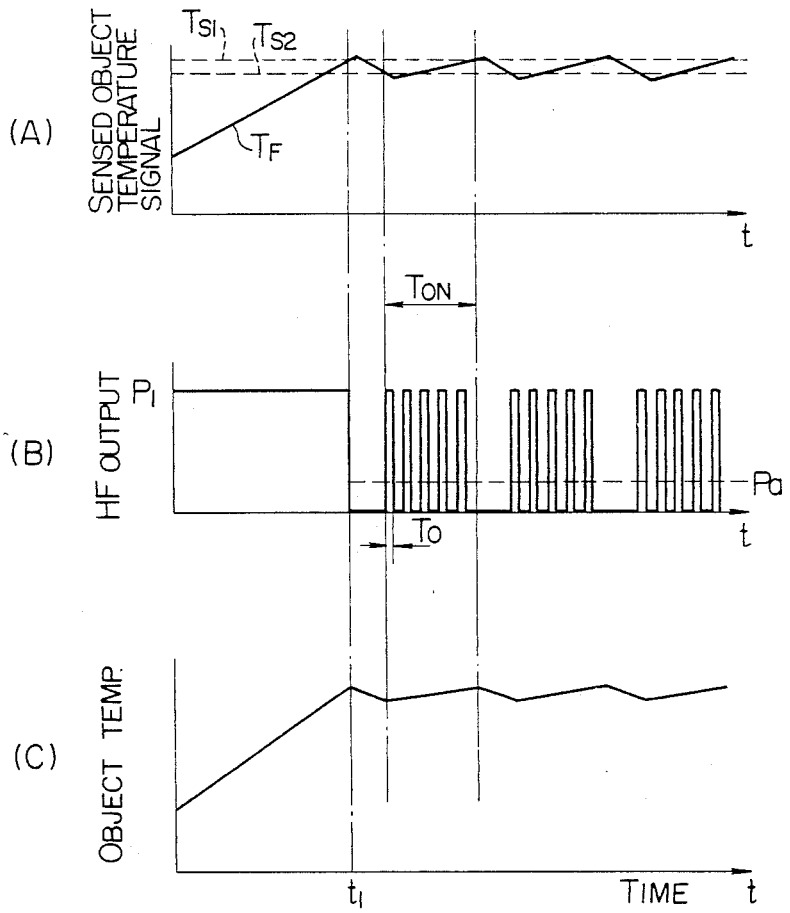
FIG. 5 illustrates a method of high-frequency output control in another embodiment of the present invention.

In a modification of the means for changing over the high-frequency output of the high-frequency oscillator 3, the peak value of the high-frequency heating power may be maintained at, for example, 600 watts, and a pulse generating circuit or a mechanical switch such as a cam switch may be used to periodically turn on-off the oscillation of the high-frequency oscillator 3 so as to effectively change over the high-frequency output to the reduced power level. The mode of oscillation of the high-frequency oscillator 3 in such a modification will be described with reference to FIG. 5. FIG. 5 shows in (A) the temperature signal $T_F$ indicative of the sensed temperature of the object being heated, in (B) the high-frequency output of the high-frequency oscillator 3, and in (C) the temperature of the object being heated. After time $t_1$ at which the level of the temperature signal $T_F$ has initially attained the level of the first temperature setting $T_{S1}$, the high-frequency oscillator 3 is periodically turned on-off in a manner as shown in a period $T_{ON}$ in (B) of FIG. 5 so that its effective heating power is reduced. This reduced effective heating power corresponds to P2 shown in (F) of FIG. 4. Referring to FIG. 5, the oscillation of the high-frequency oscillator 3 is entirely stopped in a period $T_{OFF}$ in which the level of the temperature signal $T_F$ exceeds the first temperature setting $T_{S1}$ and then falls below the second temperature setting $T_{S2}$. In a subsequent period $T_{ON}$ in which the level of the temperature signal $T_F$ lower than the second temperature setting $T_{S2}$ exceeds the first temperature setting $T_{S1}$ again, the high-frequency oscillator 3 is periodically turned on-off a plurality of times to provide the effective heating power corresponding to P2 shown in (F) of FIG. 4 in this period $T_{ON}$. *Thereafter, the periods* $T_{ON}$ and $T_{OFF}$ repeat alternately depending on the level of the temperature signal $T_F$ indicative of the sensed temperature of the object being heated, so that the ultimate effective heating power supplied after the time $t_1$ is Pa which is lower than P2. In this manner, the high-frequency oscillator 3 is periodically turned on-off after the time $t_1$ in the modification described with reference to FIG. 5. Each of the on-durations $T_0$ in the period $T_{ON}$ is preferably selected to be as short as possible in order to prevent boil-over of the soup. It will be seen that this modification can also obviate boil-over of the soup and can supply the appropriate high-frequency output depending on the temperature of the object being heated. Thus, this modification is as effective as the first embodiment described with reference to FIGS. 3 and 4.

Figure 6:
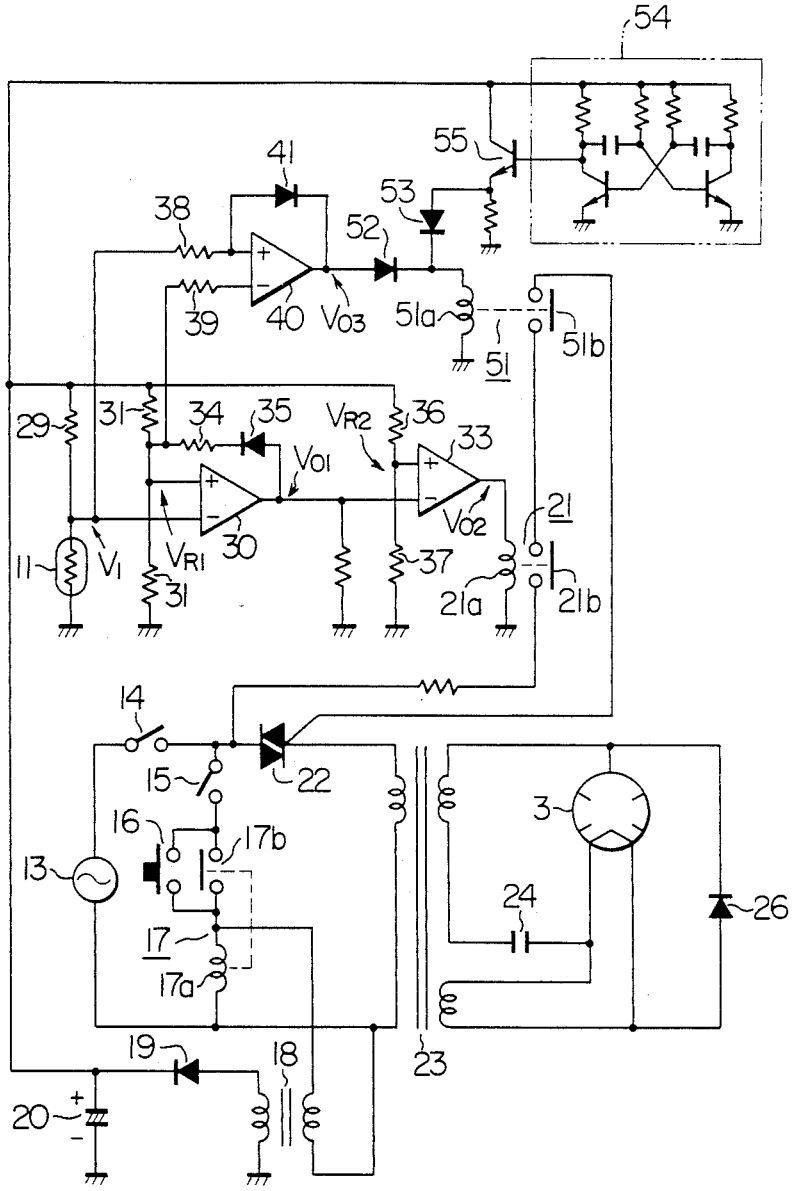
FIG. 6 is a circuit diagram of another high-frequency output control circuit preferably employed in the high-frequency heating apparatus according to the present invention shown in FIG. 2.

FIG. 6 shows an embodiment for realizing the invention illustrated in FIG. 5. In FIG. 6, same reference numerals are used to designate the same as or similar to those parts utilized in FIG. 3. As seen in FIG. 6, a contact 21*b* of a relay 21 and a contact 51*b* of a relay 51 are connected in series to form an AND circuit. The reference numeral 54 designates an astable multivibrator which repeats its ON-OFF operation continuously with a preset period. Before the time $t_1$ has been reached, namely for a period during which the output voltage $V_{03}$ of the comparator 40 is high, the coil 51*a* of the relay 51 is energized to close its contact 51*b* so that the contact 51*b* is not influenced by the state of the astable multivibrator 54. For this period, on the other hand, the output voltage $V_{02}$ of the comparator 33 is also high and hence the coil 21*a* of the relay 21 is also energized to close its contact 21*b*. When the temperature of the food being heated has reached the predetermined value, namely when the temperature sensed value $T_F$ has reached the preset value $T_{S1}$, the voltage $V_1$ becomes less than the reference voltage $V_{R1}$ so that the output voltage $V_{03}$ of the comparator 40 becomes low. Accordingly, the energization of the coil 51*a* of the relay 51 is influenced by the output status of the astable multivibrator 54 such that when the output of the astable multivibrator 54 is high the transistor 55 is turned on to energize the relay coil 51*a* and vise versa. Namely, the ON-OFF status of the relay contact 51*b* corresponds to the ON-OFF status of the output of the astable multivibrator 54 and in turn the triac 22 is turned on and off in response to the ON-OFF status of the relay contact 51*b*. Thus, the output of the high-frequency oscillator 3 is chopped in the period $T_{ON}$ to thereby reduce the effective output energy, while without changing the amplitude of the output, as shown in FIG. 5. The function of the relay 21 through the comparators 30 and 33 is the same as that described with respect to FIG. 3. Namely, when the temperature of the food being heated reaches a preset value so that the sensed signal $T_F$ becomes the value $T_{S1}$, the relay contact 21*b* is rendered open and when the sensed signal goes down to the value $T_{S2}$ the relay contact 21*b* is closed again. Since the relay contacts 21*b* and 51*b* are connected in series to form an AND circuit, as described above, it will be easily appreciated that the output of the high-frequency oscillator 3 changes as shown in (B) of FIG. 5.

Although description has been made such that the astable multivibrator repeates ON-OFF operation with a preset period, it will easily be appreciated that the astable multivibrator 54 may of course be replaced by a pulse generating circuit whose pulse rate may be controlled externally.

In the aforementioned embodiments of the present invention, the two different levels $T_{S1}$ and $T_{S2}$ are employed as the temperature settings for the temperature signal $T_F$ indicative of the sensed temperature of the object being heated so as to turn on-off the high-frequency oscillator depending on the level of the temperature signal $T_F$ relative to these temperature settings. However, the time constant of the control circuit may be selected to be sufficiently large thereby increasing the degree of delayed response. In such a case, a single temperature setting may be sufficient for the on-off control of the oscillation of the high-frequency oscillator. This arrangement is also as effective as the aforementioned embodiments of the present invention.

It will be understood from the foregoing detailed description that the method of high-frequency heating by the high-frequency heating apparatus according to the present invention comprises sensing the temperature of an object such as a food, continuously supplying a high-frequency output of full power level to quickly raise the temperature of the food until a predetermined temperature setting is reached, changing over the high-frequency output to its reduced power level (reducing the peak heating power or effective heating power) at the time of attainment of the predetermined temperature setting, and thereafter, turning on-off the high-frequency oscillator depending on the level of the temperature signal indicative of the sensed temperature of the food. According to the present invention, therefore, no boil-over of the soup from the food container occurs since, during the stage of heating after the temperature of the food has attained the predetermined temperature setting, the peak value of the high-frequency output of the high-frequency oscillator is reduced or the durations of turning on the high-frequency oscillator in each heating cycle are shortened. Further, due to the fact that the high-frequency oscillator is automatically turned on-off depending on the sensed temperature of the food, the food can be appropriately heated regardless of its amount or ingredients, and a tasty meal can be prepared without failure. Thus, undesirable disintegration of the ingredients due to excessive heating can be obviated and wasteful consumption of the heating power can be avoided.

What is claimed is:

1. A high-frequency heating apparatus comprising:

a heating chamber which is capable of accommodating an object to be heated therein;

first means for generating high-frequency energy and for supplying the generated high-frequency energy into said heating chamber;

second means for sensing the temperature of an object placed within said heating chamber and for providing an output representative thereof; and control means responsive to the output of said second means for controlling said first means to reduce the output high-frequency energy of said first means after the output of said second means has reached a first predetermined value, and including third means for intermittently interrupting the reduced output of said first means, after the output of said second means has reached said first predetermined value, in accordance with the output of said second means.

2. An apparatus as defined in claim 1, wherein said first means includes high-frequency oscillating means for generating high-frequency energy and fourth means for supplying the high-frequency energy generated by said high-frequency oscillating means into said heating chamber, and wherein said control means includes fifth means for applying externally-received electric power to said high-frequency oscillating means to energize said high-frequency oscillating means.

3. An apparatus as defined in claim 2, wherein said control means further includes sixth means for controlling said fifth means to reduce the electric power to be applied to said high-frequency oscillating means after the output of said second means has reached said first predetermined value to thereby redue the output high-frequency energy of said high-frequency oscillating means, and wherein said third means includes seventh means for controlling said fifth means to intermittently interrupt the application of said reduced electric power to said high-frequency oscillating means in accordance with the output of said second means after the output of said second means has reached said first predetermined value.

4. An apparatus as defined in claim 3, wherein said seventh means turns off the application of the electric power to the high-frequency oscillating means when the output of said second means reaches said first predetermined value and turns on the electric power application when the output of said second means reaches a second predetermined value, the on-off operation of said electric power application being repeated for a preset period of time.

5. An apparatus as defined in claim 4, wherein said fifth means includes eighth means for receiving external AC power, switching means, ninth means for generating a high voltage in response to the received AC power received through said switching means from said eighth means and for applying the high voltage to said high-frquency oscillating means to thereby actuate said high-frequency oscillating means to produce its high-frequency energy output, and wherein said seventh means includes tenth means for turning on and off said switching means in accordance with the output of said second means, and wherein said sixth means includes eleventh means for reducing the output of said ninth means.

6. An apparatus as defined in claim 5, wherein said ninth means includes high voltage rectifier means including capacitor means, and wherein said eleventh means changes the capacitance of said capacitor means to thereby change the high voltage generated by said voltage rectifier means.

7. An apparatus as defined in claim 1, wherein said apparatus comprises an air outlet for discharging heated air in said heating chamber, and wherein said second means includes a thermistor disposed at said air outlet and a current means for causing a current to flow through said thermistor, and wherein said control means includes fourth means for producing a reference voltage corresponding to said first predetermined value, and fifth means for comparing said reference voltage with the voltage across said thermistor which corresponds to the temperature of the object, the fact that said first predetermined value is reached being indicated by the output of said fifth means.

8. An apparatus as defined in claim 1, wherein said apparatus comprises an air outlet for discharging heated air in said heating chamber, and wherein said second means includes a thermistor disposed at said air outlet and current means for causing a current to flow through said thermistor, and wherein said control means includes fourth means for producing a first reference voltage corresponding to said first predetermined value, first comparing means for comparing said first reference voltage with the voltage across said thermistor which corresponds to the temperature of the object, fifth means for producing a second reference voltage corresponding to a second predetermined value, and second comparing means for comparing said second reference voltage with said voltage across said thermistor, the fact that said first and second predetermined values are reached being indicated by the outputs of said first and said second comparing means, respectively.

9. A high-frequency heating apparatus comprising a heating chamber which is capable of accommodating an object to be heated therein;

first means for generating high-frequency energy at a predetermined power level and for supplying the generated high-frequency energy into said heating chamber, including high-frequency oscillating means and means for supplying energy power to said high-frequency oscillating means;

second means for sensing the temperature of an object placed within said heating chamber and for providing an output representative thereof; and control means responsive to the output of said second means for intermittently interrupting the output of said first means at said predetermined power level including third means for turning said first means on and off by interrupting the supply of energizing power to said high frequency oscillating means at a first rate after the output of said second means has reached a first predetermined value and fourth means for interrupting the supply of energizing power not interrupted by said third means and at a second rate different from said first rate.

10. An apparatus as defined n claim 9, wherein said third means cuts off the supply of energizing power to said high-frequency oscillating means when the output of said second means reaches said first predetermined value and permits supply of said energizing power when the output of said second means reaches a second predetermined value.

11. An apparatus as defined in claim 9, wherein said energizing power supplying means includes means for receiving external electric power, switching means, and means for applying the received external electric power to said high-frequency oscillating means through said switching means to thereby cause the high-frequency oscillation, and wherein said third means includes a first triggering means for turning on and off said switching means in response to the output of said second means, and wherein said fourth means includes a second triggering means for turning on and off said switching means, said first and second triggering means being arranged in a manner so that said switching means is turned on only when both of said triggering means indicate the requirement for operation of said switching means.

12. A high-frequency heating apparatus comprising:

a heating chamber which is capable of accommodating an object to be heated therein;

first means for generating high-frequency energy at a first power level and for supplying the generated high-frequency energy at said first power level into said heating chamber;

second means for sensing the temperature of an object placed within said heating chamber and for providing an output representative thereof; and control means responsive to the output of said second means for controlling said first means to reduce the output high-frequency energy of said first means from said first power level to a lower second power level after the output of said second means has reached a first predetermined value, and including third means for intermittently cutting off the output of said first means at said second power level, after the output of said second means has reached said first predetermined value, in accordance with the output of said second means.

13. An apparatus as defined in claim 12, wherein said first means includes high-frequency oscillating means for generating said high-frequency energy and means for supplying energizing power to said high-frequency oscillating means, and wherein said third means includes switching means connected to said energizing power supplying means for selectively interrupting the supply of energizing power to said high-frequency oscillating means and means responsive to said second means for controlling said switching means to intermittently interrupt the supply of energizing power after the output of said second means has reached said first predetermined value.

14. An apparatus as defined in claim 13, wherein said means for controlling said switching means includes temperature detecting means responsive to the output of said second means for controlling said switching means to cause energizing power to be supplied to said high-frequency oscillating means when the output of said second means has reached a second predetermined value which represents a temperature which is lower than the temperature represented by said first predetermined value and for controlling said switching means to cause energizing power to be cut off from said high-frequency oscillating means when the output of said second means has reached said first predetermined value.

15. An apparatus as defined in claim 14, wherein said temperature detecting means includes a first comparator having a first input connected to said second means, a second input connected to a first reference voltage source and a feedback circuit connected between the output of the first comparator and said second input thereof, and a second comparator having a first input connected to the output of said first comparator and a second input connected to a second reference voltage source, and means for supplying the output of said second comparator to said switching means.

16. An apparatus as defined in claims 13 or 14, wherein said means for supplying energizing power to said high-frequency oscillating means includes means responsive to said second means for reducing the level of the energizing power supplied to said high-frequency oscillating means so as to reduce the average power output thereof by reducing the output high-frequency energy from said first power level to said second power level coincident with the intermittent operation of said high-frequency oscillating means by said third means.

17. A high-frequency heating apparatus comprising:

a heating chamber which is capable of accommodating an object to be heated therein;

first means for generating high-frequency energy at a predetermined power level and for supplying the generated high-frequency energy into said heating chamber, including high-frequency oscillating means for generating said high-frequency energy and means for supplying energizing power to said high-frequency oscillating means;

second means for sensing the temperature of an object placed within said heating chamber and for providing an output representative thereof;

switching means connected to said means for supplying energizing power to said high-frequency oscillating means for controlling the on-off operation of said high-frquency oscillating means;

third means for controlling said switching means to turn said high-frequency oscillating means on and off in alternate periods of predetermined length at a first frequency in a repetitive manner when the output of said second means has reached a first predetermined value; and fourth means for controlling said switching means to turn said high-frequency oscillating means on and off at a second frequency whis is higher than said first frequency, so as to control the average power output of said high-frequency oscillating means.

18. An apparatus as defined in claim 17, wherein said third means for controlling said switching means includes temperature detecting means responsive to the output of said second means for controlling said switching means to cause energizing power to be supplied to said high-frequency oscillating means when the output of said second means has reached said first predetermined value and for controlling said switching means to cause energizing power to be cut off from said high-frequency oscillating means when the output of said second means has reached a second predetermined value which represents a temperature which is lower than the temperature represented by said first predetermined value.

19. An apparatus as defined in claim 18, wherein said temperature detecting means includes a first comparator having a first input connected to said second means, a second input connected to a first reference voltage source and a feedback circuit connected between the output of the first comparator and said second input thereof, and a second comparator having a first input connected to the output of said first comparator and a second input connected to a second reference voltage source, and means for supplying the output of said second comparator to said switching means.

20. An apparatus according to claim 17, wherein said switching means comprises a voltage-controlled switching device having a control terminal, and first and second switches connected in series between said control terminal and a source of energizing voltage for said switching device, said third and said fourth means being connected to selectively operate said first and second switches, respectively.

* * * * *